United States Patent [19]

Venne

[11] Patent Number: 4,867,330

[45] Date of Patent: Sep. 19, 1989

[54] SERVING TRAY

[76] Inventor: Maurice Y. P. Venne, 5103 Richenbacher Ave., Alexandria, Va. 22304

[21] Appl. No.: 266,011

[22] Filed: Nov. 2, 1988

[51] Int. Cl.[4] ..... B65D 25/00

[52] U.S. Cl. ..... 220/23.4; 220/23.83; 220/83; 206/557; 206/562

[58] Field of Search ..... 220/83, 85 H, 23.4, 220/23.83, 405; 206/557, 562

[56] References Cited

U.S. PATENT DOCUMENTS

| | | | |
|---|---|---|---|
| 586,195 | 7/1897 | Monroe | 220/23.4 |
| 982,351 | 1/1911 | Cree et al. | 206/562 X |
| 1,283,482 | 11/1918 | Durkee | 220/23.4 X |
| 1,583,523 | 5/1926 | Briscoe | 220/23.4 X |
| 2,058,002 | 10/1936 | Daum | 220/23.4 X |
| 2,419,229 | 4/1947 | Preis | 220/23.83 X |
| 3,029,969 | 4/1962 | Buchel | 220/20 |
| 3,398,827 | 8/1968 | Laskin | 220/23.4 X |
| 3,504,832 | 4/1970 | Corvetti | 206/557 X |
| 3,888,348 | 6/1975 | Frey | 220/23.4 X |
| 3,944,109 | 3/1976 | Holz | 220/20 |
| 4,264,902 | 3/1981 | Whitney | 340/602 X |

*Primary Examiner*—Steven M. Pollard
*Attorney, Agent, or Firm*—Staas & Halsey

[57] ABSTRACT

A serving tray for carrying a plurality of plates includes a planar member having upper and lower surfaces and a peripheral edge and a lip extending upwardly from the upper surface of the planar member at the peripheral edge thereof. The planar member is symmetrically shaped to form a plurality of plate retaining areas, with the lip and peripheral edge forming a plurality of curved segments which partially define a portion of the plate retaining areas. The lip has a contour which conforms in shape to the outer perimeter area of the plurality of plates so as to hold the plurality of plates thereon within the plate retaining areas.

5 Claims, 2 Drawing Sheets

SERVING TRAY

BACKGROUND OF THE INVENTION

1. Field of the Invention

The present invention relates generally to serving trays, and more specifically, to a serving tray which has a plurality of plate retaining areas.

2. Description of the Related Art

Serving trays used in the food service industry are generally oval in shape and can hold a maximum of four plates. In restaurants and hotels, it is common practice amongst waiters and waitresses who are serving more than four people to stack plates of food on top of each other when using the standard oval serving tray in order to serve large tables in a single trip. The result is that the food on the bottom plates becomes mashed, or the food from the upper plates spills onto the lower plates, neither of which is a desirable consequence.

Some serving trays, either oval or circular, are provided with slightly upturn edges which are sometimes used to support plates thereon at an angle in order to fit more plates on the service tray than the designed capacity. Frequently, this results in food spilling from plate to plate, or plate to tray.

Others have made variations of the basic serving tray. For example, U.S. Pat. No. 4,264,902, issued Mar. 10, 1981 to Whitney described a container assembled for food items which has a peripheral shape of six partial circles joined together. However, the assembly is made of a flexible fabric composed of a plurality of different sheets which are interconnected to form a plurality of pockets which hold and display food.

U.S. Pat. No. 3,944,109, issued Mar. 16, 1976 to Holz described a triangularly shaped serving tray which has three partial circular peripheral areas joined together by a relatively flat area that potentially permits a serving dish to be placed in the three corners thereof. However, the tray was designed to have an insert therein which contains the three containers. The insert can form the serving tray on its own with the serving tray itself being discarded.

U.S. Pat. No. 982,351 issued Jan. 24, 1911 to Cree et al. describes a serving tray in which an upper surface is provided with a plurality of holes for receiving drinking cups.

U.S. Pat. No. 2,895,609, issued July 21, 1959 to Rajotte describes a serving tray having separate receiving areas defined by a partition plate. The serving tray is circular in shape and is provided with a chord-division between receiving areas.

U.S. Pat. No. 3,029,969, issued Apr. 17, 1962 to Buchel describes a serving tray having partitioned areas for different eating utensils.

U.S. Pat. No. 3,504,832, issued Apr. 7, 1970 to Corvetti describes a serving tray having a contoured lower surface to receive the arm of a waitress. The upper surface is circular and flat.

The aforementioned known serving trays do not solve the problem of providing a single serving tray which can accommodate a plurality of plates without spilling and without detracting from the appearance of the food on the plates.

SUMMARY OF THE INVENTION

An object of the present invention is to provide a serving tray which is capable of carrying a plurality of plates without having to stack the plates on top of each other.

Another object of the present invention is to provide a serving tray which maximizes the number of plates which can be carried per given amount of plate receiving area.

Another object of the invention is to provide a serving tray which is capable of displaying food on a plurality of plates in an esthetically pleasing manner.

Another object of the invention is to provide a serving tray which has a simple construction and is capable of maintaining a plurality of plates in respective positions on plate retaining areas thereof.

Another object of the invention is to provide serving tray which is easily stacked and cleaned by having only curvilinear surfaces.

Another object of the invention is to provide a serving tray which is relatively cost effective to produce.

To achieve the foregoing and other objects of the present invention and in accordance with the purposes of the invention there is provided a serving tray for carrying a plurality of plates, each plate having an outer perimeter area, and including a planar member having upper and lower surfaces and a peripheral edge, a lip extending upwardly from the upper surface of the planar member at the peripheral edge thereof, the planar member being symmetrically shaped to form a plurality of plate retaining areas, with the lip and peripheral edge forming a plurality of curved segments, each of which partially defines one of the plurality of plate retaining areas, the lip having a curved contour throughout the plurality of curved segments which substantially conforms in shape to the outer perimeter area of the plurality of plates so as to hold the plurality of plates thereon within plate retaining areas corresponding to the curved segments.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 1:
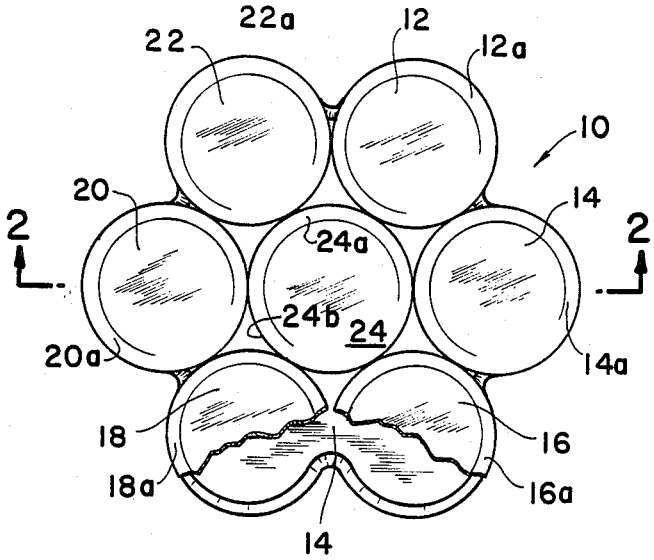
FIG. 1 is a top plan view of a serving tray according to a first preferred embodiment of the present invention, with a plurality of plates disposed thereon and partially cut-away.
Figure 2:
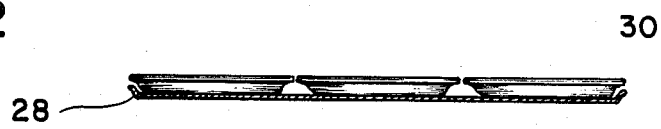
FIG. 2 is a cross-sectional view of a serving tray of FIG. 1, with plates shown thereon.
Figure 2A:
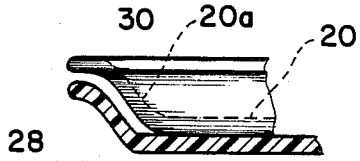
FIG. 2*a* is an enlarged view of an edge portion of the serving try of FIG. 2.
Figure 3:
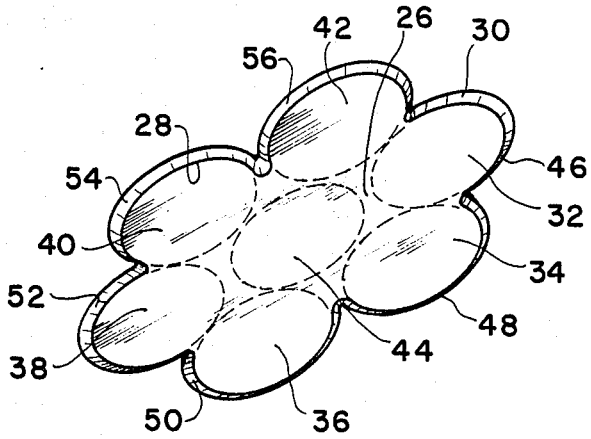
FIG. 3 is a perspective view of the serving tray of FIG. 1, without plates.
Figure 4:
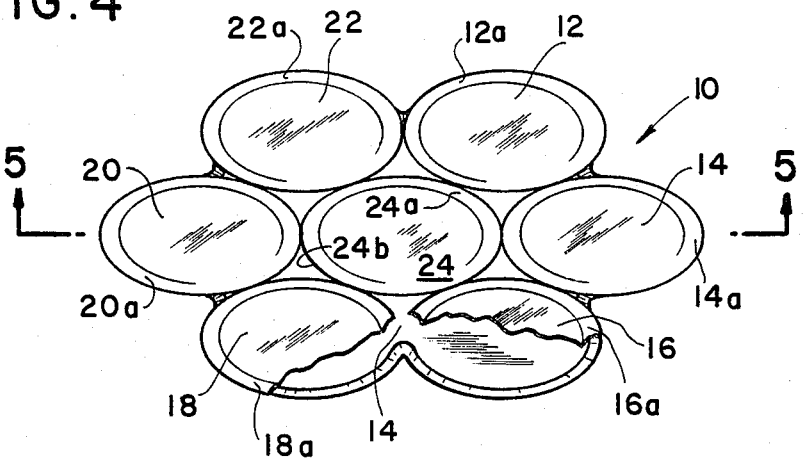
FIG. 4 is a top plan view of a second preferred embodiment of the present invention.
Figure 5:
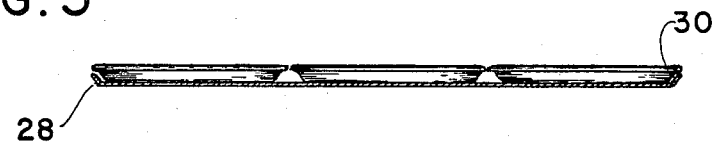
FIG. 5 is a cross-sectional view of the embodiment of FIG. 4.
Figure 6:
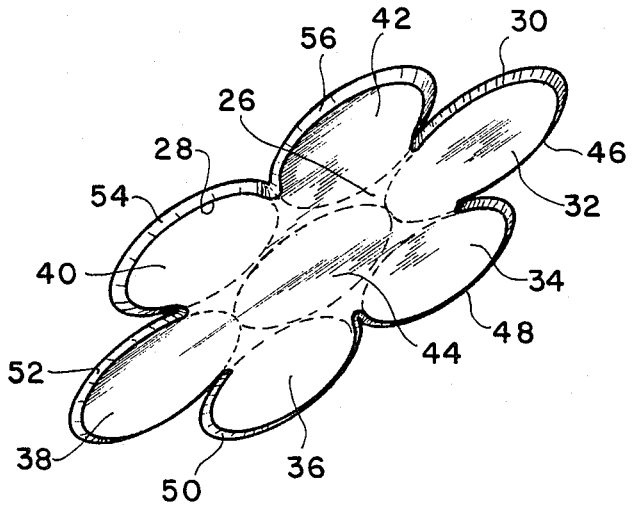
FIG. 6 is a perspective view of the embodiment of FIG. 4.

Referring to FIGS. 1–3, a serving tray 10 carries a plurality of plates 12, 14, 16, 18, 20, 22 and 24, each having an outer perimeter area 12*a*, 14*a*, 16*a*, 18*a*, 20*a*, 22*a* and 24*a*, respectively. In the illustrated preferred embodiment, the serving tray 10 holds seven plates, one (24) being held centrally, and the others being held around the central one with circumferential edges in or near abutment with the circumferential edge of the central plate.

The serving tray 10 includes a planar member 26 having upper and lower surfaces and a peripheral edge 28. A lip 30 extends upwardly from the upper surface of the planar member at the peripheral edge 28 thereof and preferably has a curved contour.

The planar member is symmetrically shaped to form a plurality of plate retaining areas 32, 34, 36, 38, 40, 42, 44. The lip 30 and peripheral edge 28 form a plurality of curved segments 46, 48, 50, 52, 54 and 56, each having a contour which substantially conforms in shape to the outer perimeter area of the plurality of plates, except for the central plate 24 The contour is preferably flared outwardly from the peripheral edge 28. When placed on the retaining areas 32, 34, 36, 38, 40, 42 and 44, the plates 12, 14, 16, 18, 20, 22 and 24 are held in position by the curved segments 46, 48, 50, 52, 54 and 56, and to a lesser extent by the centrally disposed inner plate 24 which has a peripheral edge **24*b* which abuts the circumferential edges of the outer plates 12, 14, 16, 18, 20, and 22**. Preferably, the total number of plate retaining areas is seven.

In the embodiment of FIGS. 1–3, each plate retaining area is circularly shaped, and all have the same radius. The radius is selected to conform in shape to the plates and to permit tangential abutment of the plurality of plates. Each plate has a shape compatible with the circularly shaped plate retaining areas.

In the embodiment of FIGS. 3–6, each plate retaining area has an oval shape, the size or radius of which is selected to permit tangential abutment of the plurality of plates when placed on respective plate retaining areas. Each plate has a compatible oval shape.

In either embodiment, or in other embodiments having other geometric shapes, the contoured lip cooperates with the outer perimeter of the plates in order to provide complementary means for holding the plates in respective positions on the plurality of plate retaining areas. In the various embodiments, less than the full-capacity number of plates may be carried on the serving tray, although the maximum number of plates to be carried is determined by the number of plate retaining areas formed on the serving tray. The tray may be integrally formed, molded, or stamped, depending upon materials. The preferred materials include plastic, fiber glass, and pewter.

The outer peripheral edge of the serving tray is such that no corners are formed. Corners, such as what are formed on a rectangular serving tray, are difficult to clean. Thus, the present invention provides a serving tray which is easier to clean than conventional models.

While seven plate retaining areas are preferred, the present invention may be provided with fewer plate retaining areas. However, in the preferred embodiment, the seven-plate tray is particularly well suited for serving large parties in a restaurant during peak hours. For instance, one waiter can carry seven dinners without stacking the plates or requiring additional help. The food remains on the plates, and patrons are served quicker and are provided with a full view of their dinner tastefully arranged on the tray.

The serving tray of the present invention is only slightly larger than conventional oval trays, and is much less cumbersome. The flared lip can be used to rest the tray on a waiter's shoulder during service. The plates are positioned flat on the tray, not slanted as is the case for conventional trays having rims. The lip provided on the serving tray of the present invention is specifically contoured to conform to the shape of the plates being served. Thus, a space-saving feature is achieved while positionally fixing the plates on the serving tray.

The foregoing description is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

I claim:

1. A serving tray for carrying a plurality of plates, each plate having an outer perimeter area, comprising:

a planar member having upper and lower surfaces and a peripheral edge;

a lip extending upwardly from the upper surface of the planar member at the peripheral edge thereof;

the planar member being symmetrically shaped to form a plurality of plate retaining areas, with the lip and peripheral edge forming a plurality of curved segments, each of which partially defines one of the plurality of plate retaining areas;

the lip having a curved cross-sectional contour throughout the plurality of curved segments which substantially conforms in shape to the outer perimeter areas of the plurality of plates so as to hold the plurality of plates thereon within plate retaining areas corresponding to the curved segments, wherein the plurality of plate retaining areas includes an inner plate retaining area having a center and being disposed substantially centrally of the planar member, and at least four outer plate retaining areas each having a center and being disposed around the inner plate retaining area wherein the centers of the outer plate retaining areas are equally spaced from the center of the inner plate retaining area, and wherein the inner plate retaining area and the outer plate retaining areas are sized so that adjacent plates placed on the serving tray tangentially abut each other.

2. A serving tray according to claim 1, wherein the number of outer plate retaining areas is six.

3. A serving tray according to claim 1, wherein the plate retaining areas have a geometric shape corresponding to the shape of the plurality of plates.

4. A serving tray according to claim 1, wherein the plate retaining areas are circularly shaped with equal radius, the radius being selected to permit tangential abutment of the plurality of plates when placed on the plate retaining areas.

5. A serving tray according to claim 1, wherein the plate retaining areas are oval shaped to permit tangential abutment of the plurality of plates when placed on the plate retaining areas.

* * * * *